US007438088B2

(12) United States Patent
Matsumoto et al.

(10) Patent No.: US 7,438,088 B2
(45) Date of Patent: Oct. 21, 2008

(54) ELECTROMAGNETIC PILOT TYPE DIRECTIONAL CONTROL VALVE

(75) Inventors: Takumi Matsumoto, Tsukuba-gun (JP); Bunya Hayashi, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 289 days.

(21) Appl. No.: 11/246,217

(22) Filed: Oct. 11, 2005

(65) Prior Publication Data

US 2006/0086395 A1 Apr. 27, 2006

(30) Foreign Application Priority Data

Oct. 25, 2004 (JP) ..... 2004-309839

(51) Int. Cl.
*F15B 13/043* (2006.01)

(52) U.S. Cl. ..... 137/625.64; 137/625.69

(58) Field of Classification Search ..... 137/625.64, 137/625.25, 625.69

See application file for complete search history.

(56) References Cited

U.S. PATENT DOCUMENTS 2,591,800 A * 4/1952 Gardiner ..... 137/625.63
2,634,086 A * 4/1953 Johns ..... 251/284
3,191,626 A * 6/1965 Leibfritz ..... 137/625.69
4,023,593 A * 5/1977 Piccardo ..... 137/625.64
4,150,686 A * 4/1979 El Sherif et al. ..... 137/377
5,078,179 A * 1/1992 Amrhein ..... 137/625.69
5,148,735 A * 9/1992 Veletovac ..... 91/459
6,505,642 B2 * 1/2003 Miyazoe et al. ..... 137/554
6,591,865 B2 * 7/2003 Misumi ..... 137/554

FOREIGN PATENT DOCUMENTS

JP 4-351386 12/1992
JP 8-145230 6/1996
JP 2003-89742 3/2003

* cited by examiner

*Primary Examiner*—John Rivell
*Assistant Examiner*—Craig M Schneider
(74) *Attorney, Agent, or Firm*—Oblon, Spivak, McClelland, Maier & Neustadt, P.C.

(57) ABSTRACT

To obtain a directional control valve superior in workability and maintenanceability by mounting a pilot valve, a printed circuit board and the like on a top surface of a main valve section efficiently so that easy disassembly and assembly are achieved. A valve adapter is mounted on a top surface of a housing of a main valve section with first screws, pilot valves are mounted on the valve adapter with second screws, a printed circuit board is disposed above the pilot valves, and is electrically connected thereto, a protective cover for covering the valve adapter, the pilot valves, and the printed circuit board is mounted airtightly to the top surface of the housing with third screws, a pilot supply flow channel is formed between the valve adapter and the housing, and relay holes for bringing the pilot valves into communication with pilot flow channel ports are provided on the valve adapter.

10 Claims, 7 Drawing Sheets

ELECTROMAGNETIC PILOT TYPE DIRECTIONAL CONTROL VALVE

TECHNICAL FIELD

The present invention relates to an electromagnetic pilot type directional control valve configured to drive a spool by an electromagnetically operated pilot valve.

BACKGROUND ART

An electromagnetic pilot type directional control valve configured to drive a spool that slides within a valve aperture for switching flow channel by one or two electromagnetically operated pilot valves is known in the related art. In the directional control valves of this type, the pilot valve is mounted to one or both ends of the housing in the axial direction or on a top surface of the housing. The directional control valve having a pilot valve on the top surface of the housing as in the latter case has an advantage such that the widthwise length can be reduced, and hence is suitable to be used in a space which is narrow in width.

Patent Document 1 discloses a directional control valve having a pilot valve mounted on a top surface of housing. This directional control valve has the pilot valve covered by a protective cover, and is superior in waterproof property, and hence there is no specific problem in terms of function. However, since the pilot valve is mounted directly on the top surface thereof, a plurality of pilot flow channels that extend in the interlacing directions with respect to each other must be formed in the housing along selected routes while being bent where needed in order to avoid mutual intersection. In addition, a plurality of screw holes for mounting the pilot valve must also be formed at positions where interference with the pilot flow channels is avoided. Therefore, there is a slight difficulty in workability.

What is generally required for the directional control valve of this type is that parts such as a pilot valve and a printed circuit board related thereto are assembled compactly and efficiently to the housing. It is also important that those parts can be dismounted easily from the housing in sequence and mounted easily again to the housing in sequence.

Japanese Unexamined Patent Application Publication No. 8-145230

DISCLOSURE OF INVENTION

It is an object of the invention to provide an electromagnetic pilot type directional control valve superior in workability and maintenanceability in which parts such as a pilot valve and a printed circuit board related thereto can be mounted efficiently to a top surface of a housing and operations such as disassembly or reassembly of the respective parts can be achieved in sequence easily without forming pilot flow channels which are interlacing and being bent in a complicated manner or a plurality of screw holes for mounting the pilot valve on the housing.

In order to solve the above-described problem, an electromagnetic pilot type directional control valve of the present invention includes: a main valve section having a housing of a rectangular shape in cross-section, the housing being provided with a supply port, an output port, and a discharge port for main fluid, a spool for switching a flow channel among these ports, and a piston and a pilot pressure chamber for driving the spool; a valve adapter mounted on a top surface of the housing; a pilot operating unit installed on the top surface of the housing via the valve adapter for supplying pilot fluid to the pilot pressure chamber by a pilot valve to drive the spool, and is characterized in that the pilot operating unit includes the electromagnetic operated pilot valve mounted on the valve adapter, a printed circuit board arranged above the pilot valve and electrically connected to the pilot valve, and a protective cover mounted airtightly to the top surface of the housing for covering the valve adapter, the pilot valve and the printed circuit board entirely, and in that the valve adapter defines a pilot supply flow channel that is led up to the supply port in cooperation with the top surface of the housing and having a relay hole for bringing the pilot valve into communication with the respective pilot flow channel ports opening on the top surface of the housing.

According to a specific structure of the present invention, the valve adapter assumes a plate shape elongated in the direction of an axis of the housing, and is formed with two valve mounting sections for mounting the pilot valve on the top surface thereof at relative positions, and the top surface of the housing is formed with a recess having substantially the same shape as the valve adapter and a cover mounting surface around the recess, so that the valve adapter is mounted to the recess in the state of being fitted therein via a gasket, and the protective cover is mounted to the cover mounting surface via the gasket.

In the present invention, preferably, the valve adapter is detachably attached to the housing with first screws, the pilot valve is detachably mounted to the valve adapter with second screws at a position where screwing and unscrewing of the first screws are not impaired, the printed circuit board is mounted within the protective cover, and the protective cover is detachably attached to the housing with third screws.

In the present invention, preferably, a first connector unit is provided on the top surface of the pilot valve, and a second connector unit is provided on the bottom surface of the printed circuit board, so that the connector units are electrically connected to each other in a plug-in manner when the printed circuit board is installed at a predetermined position above the pilot valve.

According to a preferable structure of the present invention, a receiving connector for the pilot valve is provided on the top surface of the protective cover, and respective terminals of the receiving connector pass through the protective cover airtightly and extend between the inside and the outside of the cover, and the distal ends thereof are electrically connected to the printed circuit board.

According to another preferable structure of the present invention, end plates are mounted to both end surfaces of the housing in the axial direction, pilot pressure chambers are defined and formed between the end plates and the respective pistons, the receiving connector for the pilot valve is provided on one of the end plates, and the respective terminals of the receiving connector are electrically connected to the printed circuit board.

According to the present invention, since the pilot valve is mounted to the valve adapter, and the pilot supply flow channel and the pilot communication hole are formed utilizing the valve adapter, it is not necessary to form the pilot flow channels extending in the interlacing directions and being bent in a complicated manner on the housing or to select positions for forming screw holes for mounting the pilot valve in order to avoid interference with these flow channels, whereby easiness of designing and superior workability are achieved. Also, the parts such as the pilot valve and the printed circuit board can be assembled on the top surface of the housing efficiently by utilizing the valve adapter, and hence easy disassembly and reassembly and superior maintenanceability are achieved.

BEST MODE FOR CARRYING OUT THE INVENTION

Figure 1:
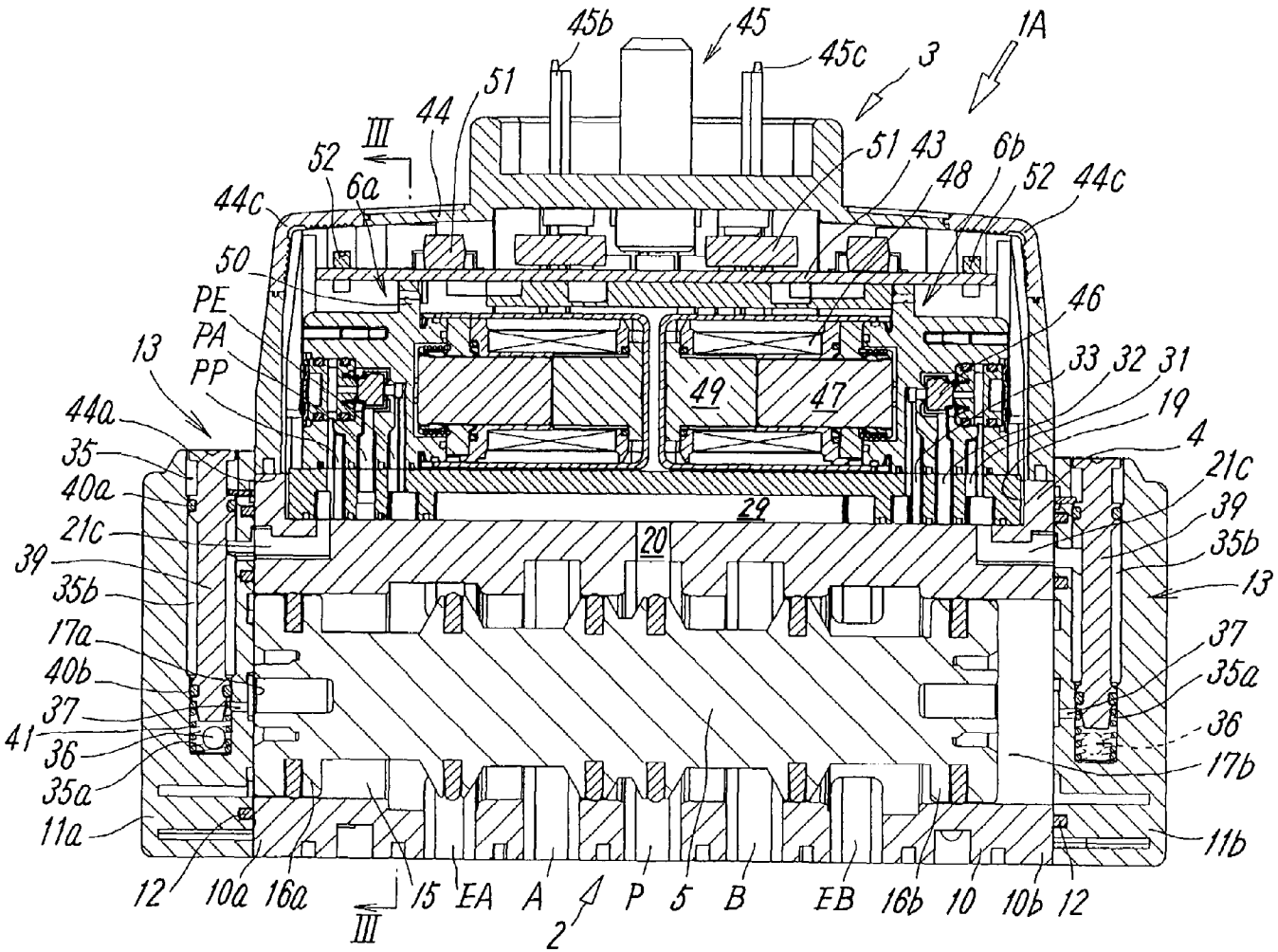
FIG. 1 is a cross-sectional view showing a first embodiment of a directional control valve according to the present invention.
Figure 2:
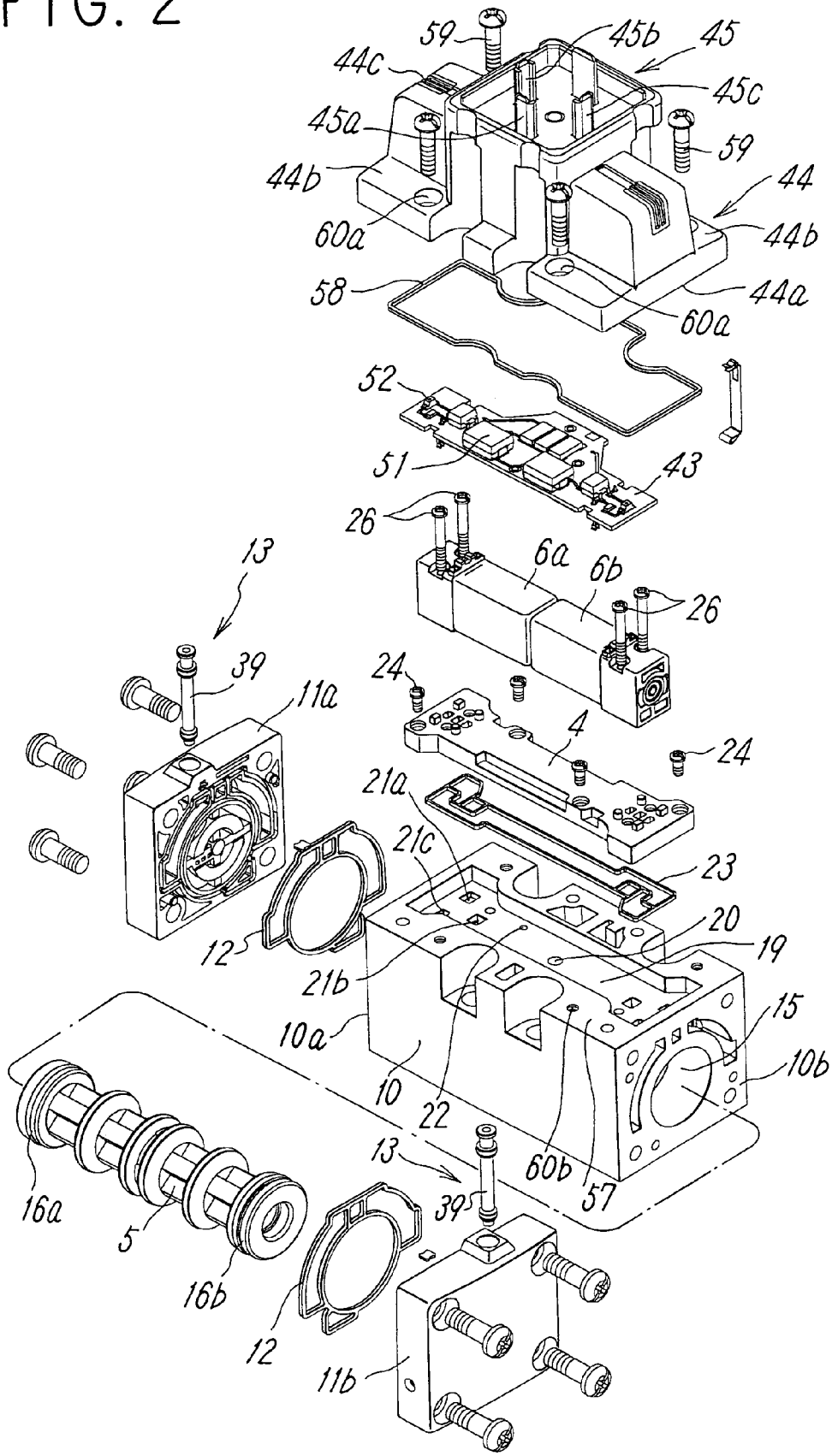
FIG. 2 is an exploded perspective view of FIG. 1.

FIG. 1 and FIG. 2 show a first embodiment of an electromagnetic pilot type directional control valve according to the present invention. The directional control valve 1A is a double-pilot type directional control valve and includes a main valve section 2 for diverting a flow channel of a main fluid by a spool 5 and a pilot operating unit 3 for driving the spool 5 by controlling the pilot fluid by two electromagnetically operated pilot valves 6*a*, 6*b*. The pilot operating unit 3 is installed on a top surface of the main valve unit 2 via a valve adapter 4.

The main fluid and the pilot fluid may either be liquid or air.

The main valve section 2 has a 5-port valve structure and includes a housing 10 being elongated in an axial direction and having substantially rectangular shape in cross section, and a first end plate 11*a* and a second end plate 11*b* mounted airtightly to a first end 10*a* and a second end 10*b* of the housing in the axial direction via gaskets 12. The end plates 11*a*, 11*b* each are provided with a manual operating device 13.

The housing 10 includes a valve hole 15 extending therein in the axial direction, five ports P, A, B, EA and EB for supplying, outputting, and discharging the main fluid which communicate with the valve hole 15 at different positions, and the spool 5 that slides within the valve hole 15 for switching the communicating state of the flow channels among these ports. These ports P, A, B, EA, EB open on the lower surface of the housing 10 at a predetermined arrangement.

A first piston 16*a* and a second piston 16*b*, being the same in diameter and surface area of pressure receiving surface, are formed integrally at both axial ends of the spool 5, and a first pilot pressure chamber 17*a* and a second pilot pressure chamber 17*b* are defined and formed between the pressure receiving surfaces, which correspond to outer end surfaces of the pistons 16*a*, 16*b*, and the end plates 11*a*, 11*b*, respectively. As shown in FIG. 1, when pilot fluid is supplied to the second pilot pressure chamber 17*b*, the spool 5 moves leftward to assume a diverted position shown in the drawing, whereby the supply port P and a second output port B are brought into communication with each other, and the first output port A and the first discharge port EA are brought into communication with each other. In contrast, when the pilot fluid is supplied to the first pilot pressure chamber 17*a*, the spool 5 moves rightward and assumes a diverted position opposite from the position shown in FIG. 1, whereby the supply port P and the first output port A are brought into communication with each other, and the second output port B and the second discharge port EB are brought into communication with each other.

The pistons 16*a*, 16*b* described above are not necessarily required to be integral with the spool 5, and may be formed separately from the spool 5 and brought into abutment with or connected to the end surfaces of the spool 5.

Figure 5:
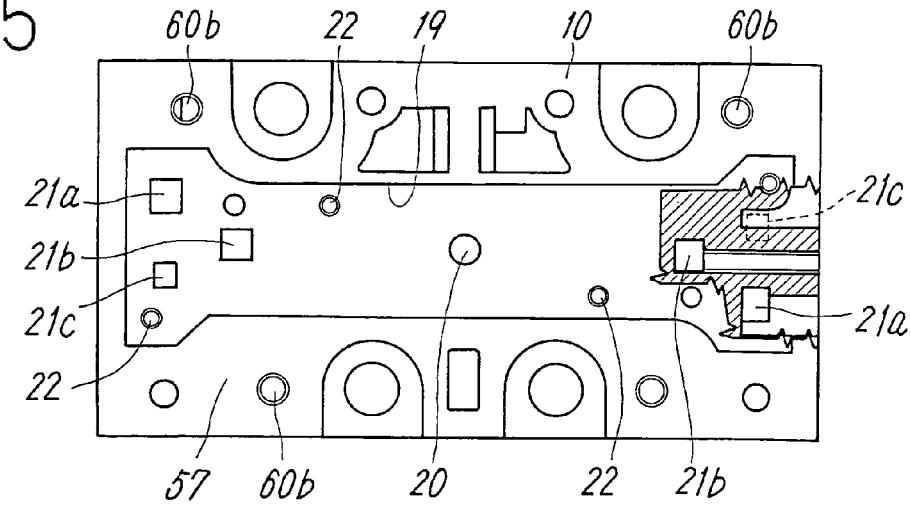
FIG. 5 is a plan view of a housing.

As will be understood from FIG. 5, a recess 19 extending longitudinally in the direction of the axis of the housing 10 is formed at a center of the top surface of the housing 10. A pilot supply branch hole 20 led up to the supply port P is formed at a center of the recess 19, and a plurality of first to third flow channel ports 21*a*, 21*b*, 21*c* are formed at symmetric positions with respect to the center of the recess 19 at positions of the wide portions at both ends of the recess 19 in the longitudinal direction. Screw holes 22 for mounting the valve adapter 4 are formed at a plurality of positions at both ends and a midsection of the recess 19. The valve adapter 4 is detachably attached to the housing 10 by fitting the same into the recess 19 via a sealing gasket 23 and screwing the first screws 24 into the screw holes 22. The first screws 24 are specific screws used only for mounting the valve adapter 4 to the housing 10.

Figure 6:
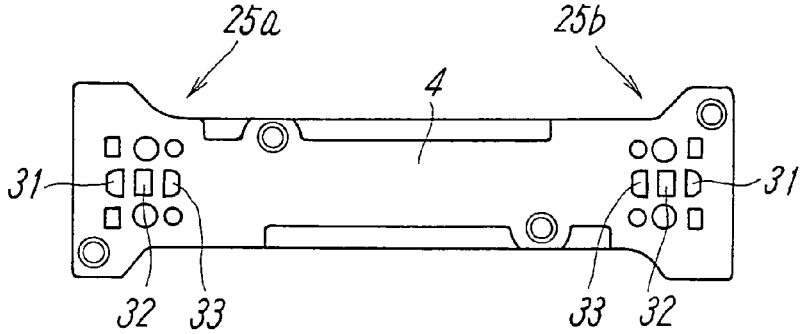
FIG. 6 is a plan view of a valve adapter.
Figure 7:
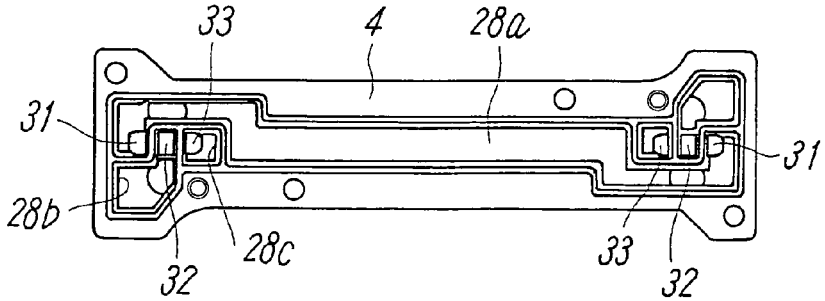
FIG. 7 is a bottom view of the valve adapter.

As clearly shown in FIG. 6 and FIG. 7, the valve adapter 4 is formed into a plate shape being elongated in the direction of the axis of the housing 10 and having wide portions at both ends thereof, and has a shape which is substantially the same as the recess 19 in plan view and a uniform thickness which is the same as or slightly larger than the depth of the recess 19, so that the valve adapter 4 in the state of being mounted in the recess 19 is flush with, or slightly projected from, the top surface of the housing 10. As shown in FIG. 6, two valve mounting sections 25*a*, 25*b* are formed symmetrically on the top surface of the valve adapter 4 at relative positions with respect to the center thereof, that is, on one half side and on the other half side in the longitudinal direction. The two, that is, the first and second pilot valves 6*a*, 6*b* having the same structure are arranged symmetrically so as to oppose to each other on these valve mounting sections 25*a*, 25*b*, and are detachably attached with specific second screws 26, respectively. The pilot valves 6*a*, 6*b* are mounted to positions where mounting and dismounting of the valve adapter 4 to/from the housing 10 with the first screws 24 are not impaired.

As seen in FIG. 7, a lower surface of the valve adapter 4 is formed with a recessed groove 28*a* which extends longitudinally along the center thereof across the two valve mounting sections 25*a*, 25*b*, and a pilot supply flow channel 29 led up to the supply branch hole 20 is defined and formed between the recessed groove 28*a* and the top surface of the housing 10. A plurality of first to third relay holes 31, 32, 33 is formed at positions corresponding to the pilot valves 6*a*, 6*b* at both ends of the valve adapter 4. The first relay holes 31 are opened in the recessed groove 28*a* and bring the supply pilot ports PP of the pilot valves 6*a*, 6*b* into communication with the pilot supply flow channel 29, the second relay holes 32 are opened within another recess 28*b* and bring the output pilot ports PA of the pilot valves 6*a*, 6*b* into communication with the first flow channel port 21*a* via the recess 28*b*, and the third relay holes 33 are opened within still another recess 28*c* and bring the discharge pilot ports PE of the pilot valves 6*a*, 6*b* into communication with the second flow channel port 21*b*.

The first flow channel ports 21*a* are led up to valve chambers 35 of a manual operating device 13, and are in communication with first chamber sections 35*a* defined under the valve chambers 35 via openings 36, the second flow channel ports 21*b* are in communication with pilot discharge ports, not shown, and the third flow channel ports 21*c* are in communication with the second chamber sections 35*b* defined above the valve chambers 35.

The manual operating devices 13 serve to reproduce the diverted state by the pilot valves 6*a*, 6*b* with manual operation, and the manual operating device 13 in the first end plate 11*a* corresponds to the first pilot valve 6*a* and the manual operating device 13 in the second end plate 11*b* corresponds to the second pilot valve 6*b*. The manual operating devices 13 each include a valve rod 39 stored in the valve chamber 35 so as to be capable of moving in the vertical direction. The valve rod 39 includes two sealing members 40*a*, 40*b* at upper and lower positions thereof, and the sealing members 40*a*, 40*b* define the valve chamber 35 into the aforementioned two upper and lower chamber sections 35*a*, 35*b*. The valve chambers 35 are in communication with the pilot pressure chambers 17*a*, 17*b* via communication holes 37.

Then, when the valve rods 39 are in a non-operative state, the lower sealing members 40*b* cut off the communication holes 37 from the third flow channel ports 21*c*, and bring the same in communication with openings 36 which are led up to the first flow channel ports 21*a*, whereby the pilot pressure chambers 17*a*, 17*b* are brought into communication with the pilot supply flow channel 29 via the pilot valves 6*a*, 6*b* as shown in FIG. 1. When the valve rods 39 are pressed downward, the lower sealing members 40*b* cut off the communication holes 37 from the openings 36 and bring the same into communication with the third flow channel ports 21*c*, whereby the pilot pressure chambers 17*a*, 17*b* are brought into direct communication with the pilot supply flow channel 29.

Reference numerals 41 in the drawing designate restoration springs for restoring the valve rods 39 to the lifted position which corresponds to the non-operative position. The valve rods 39 may be adapted to be restored to the non-operative position by a fluid pressure applied thereto. The valve rod 39 may also be adapted to be a self-retaining type thereby being engaged at the pressed position.

The pilot operating unit 3 includes the two pilot valves 6*a*, 6*b* mounted on the valve mounting sections 25*a*, 25*b* of the valve adapter 4, a printed circuit board 43 disposed above the pilot valves 6*a*, 6*b* and electrically connected to the respective pilot valves 6*a*, 6*b*, and a protective cover 44 mounted airtightly on the top surface of the housing 10 for covering entirely the valve adapter 4, the pilot valves 6*a*, 6*b* and the printed circuit board 43. The protective cover 44 is provided with a receiving connector 45 that is electrically connected to the respective pilot valves 6*a*, 6*b* via the printed circuit board 43 at a center of the top surface thereof, so that an external connector from a power source can be connected to the receiving connector 45 above the directional control valve.

Figure 3:
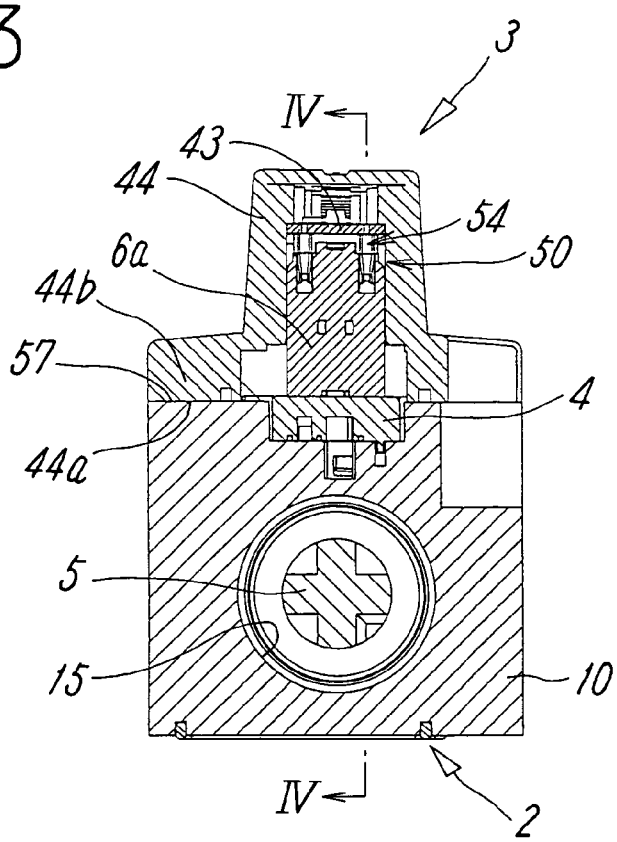
FIG. 3 is a cross-sectional view taken along the line III-III in FIG. 1.
Figure 4:
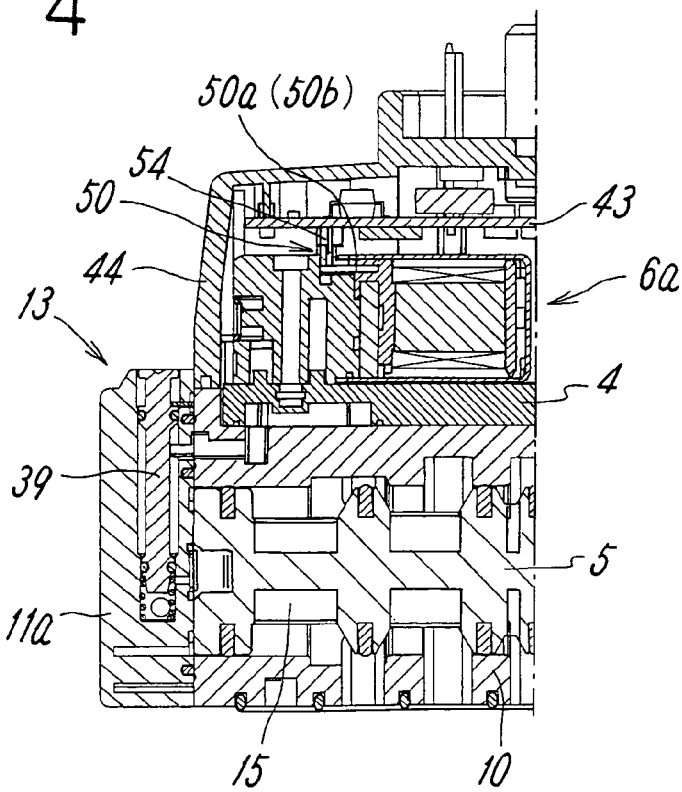
FIG. 4 is a partial cross-sectional view taken along the line IV-IV in FIG. 3.

The pilot valves 6*a*, 6*b* have substantially the same structure as a publicly known three-port type electromagnetic valve, and each include the above described pilot ports PP, PA, PE for supplying, outputting and discharging, a pilot valve member 46 for diverting the flow channels connecting these pilot ports, a moving core 47 for activating the pilot valve member 46, and an exciting coil 48 and a stationary core 49 for driving the moving core 47 with a magnetic force. The pilot valves 6*a*, 6*b* are mounted to the valve adapter 4 in a state in which the pilot ports PP, PA, PE are independently in communication with the respective relay holes 31, 32, 33, and first connector units 50 each having two coil terminals 50*a*, 50*b* that are continued to the exciting coil 48 are formed on the top surfaces of the pilot valves 6*a*, 6*b* as shown in FIG. 3 and FIG. 4.

When electric power is supplied to the exciting coil 48, the supply pilot port PP and the output pilot port PA are brought into communication with each other, and pilot fluid from the pilot supply flow channel 29 is supplied to the corresponding pilot pressure chamber 17*a*, 17*b*. When the electric power supply to the exciting coil 48 is discontinued, the supply pilot port PP is cut off, and the output pilot port PA and the discharge pilot port PE are brought into communication with each other, whereby the above-described pilot pressure chamber 17*a*, 17*b* is opened to the outside air.

Therefore, in FIG. 1, when the electric power is supplied to the first pilot valve 6*a* and is not supplied to the second pilot valve 6*b*, the pilot fluid is supplied to the first pilot pressure chamber 17*a* by the first pilot valve 6*a*, and the second pilot pressure chamber 17*b* is opened to the outside air by the second pilot valve 6*b*, and hence the spool 5 is moved rightward from the position shown in FIG. 1. In contrast, when the electric power is supplied to the second pilot valve 6*b* and is not supplied to the first pilot valve 6*a*, the pilot fluid is supplied to the second pilot pressure chamber 17*b* by the second pilot valve 6*b* and the first pilot pressure chamber 17*a* is opened to the outside air by the first pilot valve 6*a*, and hence the spool 5 is moved leftward to the position-shown in FIG. 1.

The printed circuit board 43 is disposed so as to extend across the two pilot valves 6*a*, 6*b*, and almost covers the upper portions of the two pilot valves 6*a*, 6*b*. The printed circuit board 43 is formed with two sets of the control circuits each having electronic parts 51 such as a diode or a resistor and a display lamp 52 by printing. As will be understood from FIG. 3 and FIG. 4, two second connector units 54 each having two connector terminals extending downward from the board 43 are formed at positions corresponding to the first connector units 50 of the respective pilot valves 6*a*, 6*b*. When the printed circuit board 43 is installed on a predetermined position above the pilot valves 6*a*, 6*b*, the second connector units 54 are electrically connected to the first connector units 50 of the respective pilot valves 6*a*, 6*b* in a plug-in manner. The printed circuit board 43 is mounted to the interior of the protective cover 44 by a method such as screwing or engaging with a hook, thereby being mounted or dismounted to/from the housing 10 together with the protective cover 44.

The receiving connector 45 includes three terminals 45*a*, 45*b*, 45*c*, and the distal ends of these three terminals airtightly pass through the protective cover 44 and project from the upper surface, and the proximal ends thereof are electrically connected to the two sets of the control circuits on the printed circuit board 43 in the interior of the protective cover 44. In other words, the first terminal 45*a* is commonly connected to the two sets of the control circuits as a common terminal, and the remaining second terminal 45*b* and the third terminal 45*c* are connected to the two sets of the control circuits independently as the independent terminals. However, it is possible to provide four independent terminals and connect two each to the respective control circuits. It is also possible to mount the printed circuit board 43 to the protective cover 44 by soldering the respective terminals to the printed circuit board 43.

The protective cover 44 has a shape like a hood, and includes a rectangular abutting surface 44*a* around the entire circumference of a lower end portion thereof, and flange shaped mounting portions 44*b* protruding outward on the left and right sides on the lower end portions. The protective cover 44 is detachably attached to the housing 10 by bringing the abutting surface 44*a* into hermetical abutment with a cover mounting surface 57 formed on the top surface of the housing 10 so as to surround the recess 19 via the gasket 58 and screwing specific third screws 59 into screw holes 60*b* on the cover mounting surface 57 through screw insertion holes 60*a* formed on the mounting portion 44*b*. Formed on the both end portions of the top surface of the protective cover 44 at positions corresponding to the respective display lamps 52 are translucent display windows 44*c*, so that operating state of the respective pilot valves 6*a*, 6*b* can be inspected by checking the illuminating state of the display lamps 52.

The abutting surface 44*a* at the lower end of the protective cover 44 has an outer shape being substantially the same as the contour of the upper surface of the housing 10 in shape and size, and an inner shape being substantially the same as the recess 19 in shape and size. Therefore, when the protective cover 44 is mounted to the top surface of the housing 10, the entire top surface of the housing 10 is covered by the protective cover 44 completely and airtightly in substance, and hence air-tightness and waterproof property of the pilot operating unit 3 are reliably maintained.

In the directional control valve 1A in the first embodiment, in order to separate the main valve section 2 and the pilot operating unit 3, the protective cover 44 and the printed circuit board 43 are dismounted together first independently from other parts by loosening the third screws 59. Then, by loosening the second screws 26, the respective pilot valves 6*a*, 6*b* can be dismounted independently. Finally, by loosening the first screws 24, the valve adapter 4 can be dismounted from the housing 10. Alternatively, the valve adapter 4 can be dismounted with the pilot valves 6*a*, 6*b* attached. After having finished the maintenance work, it can be assembled by mounting the respective parts with the specific screws 24, 26, 59 in reverse order of the mounting procedure.

In this manner, the directional control valve 1A is advantageous not only in that the respective parts such as the pilot valves 6*a*, 6*b* or the printed circuit board 43 which constitute the pilot operating unit 3 can be assembled compactly and efficiently in sequence on the top surface of the housing 10 of the main valve section 2 via the valve adapter 4, but also in that disassembling work or reassembling work of the respective parts for maintenance can also be carried out easily in sequence.

In addition, since the pilot valves 6*a*, 6*b* are mounted to the valve adapter 4, and the pilot supply flow channel 29 and the respective relay holes 31, 32, 33 are formed utilizing the valve adapter 4, it is not necessary to form a plurality of pilot flow channels extending in the interlacing directions with respect to each other and being bent in a complicated manner in the housing 10 or to select positions for forming a plurality of screw holes for mounting the pilot valves 6*a*, 6*b* in order to avoid interference with these flow channels, whereby easiness of designing and superior workability are achieved.

Figure 8:
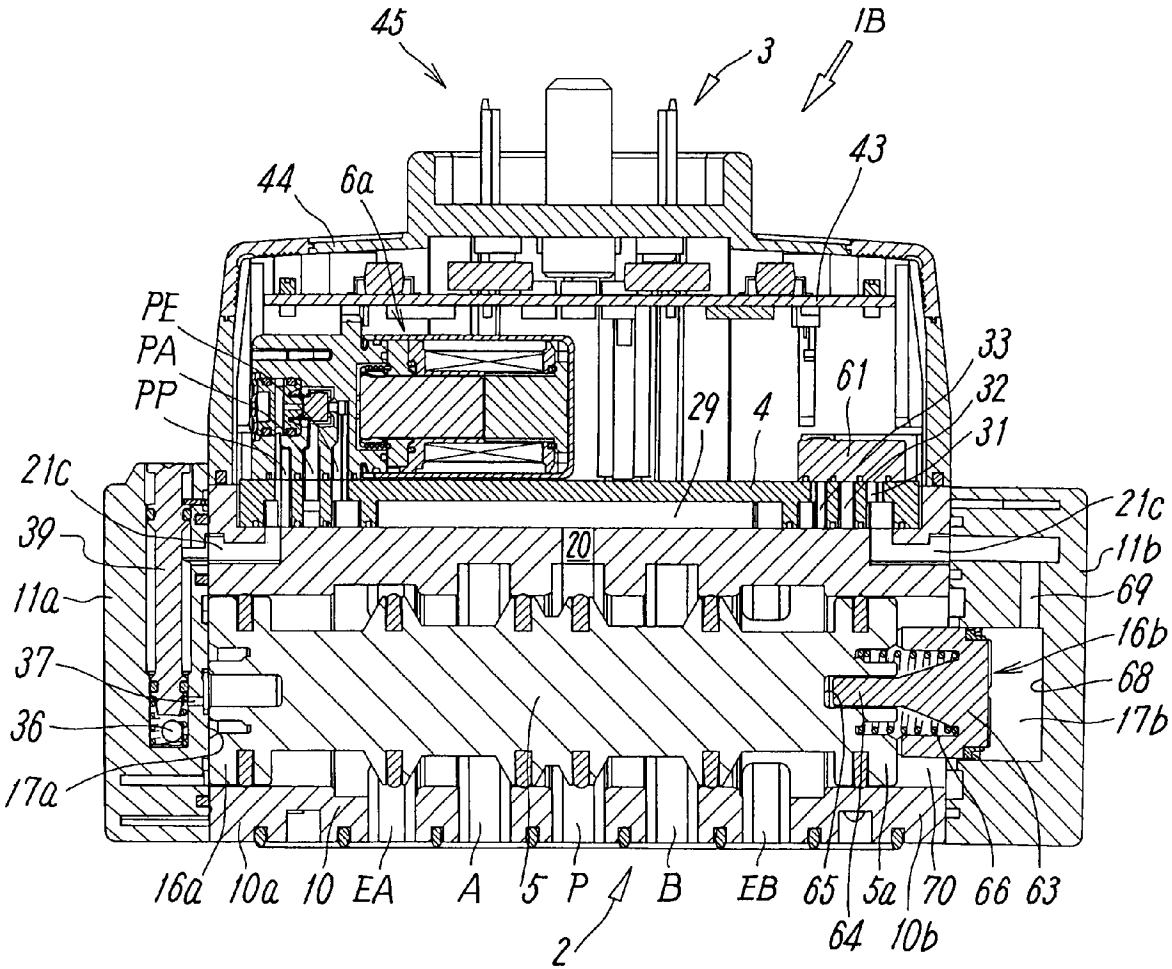
FIG. 8 is a cross-sectional view showing a second embodiment of the directional control valve according to the present invention.

FIG. 8 shows a second embodiment of the electromagnetic pilot type directional control valve according to the present invention. A directional control valve 1B in the second embodiment is a single pilot type directional control valve having only one pilot valve 6*a* and is obtained by eliminating the second pilot valve 6*b* on the right side and a function of the second piston 16*b* formed integrally with the spool 5 from the double-pilot type directional control valve 1A in the above-described first embodiment, and adding another small-diameter piston as the second piston instead. The structure of the directional control valve 1B in the second embodiment will be described mainly relating the portions different from the directional control valve 1A in the first embodiment.

Mounted on the top surface of the valve adapter 4 of the directional control valve 1B at a position where the second pilot valve 6*b* is to be mounted is a blanking plate 61 for closing the respective relay holes 31, 32, 33. The blanking plate 61 has a rectangular block shape, and is mounted to the valve adapter 4 with specific fourth screws, not shown.

A second piston 16*b* being smaller than the first piston 16*a* in diameter and surface area of pressure receiving surface is attached to a second end 5*a* of the spool 5 opposite from the first end where the first piston 16*a* is provided. The second piston 16*b* includes a pressure receiving head 63 and a connecting shaft member 64 extending from the center of the pressure receiving head 63 toward the spool 5. The connecting shaft member 64 fits into a connecting hole 65 formed at a center of the end surface of the spool 5 and is urged in the direction away from the spool 5 by a spring 66 interposed between the pressure receiving head 63 and the spool 5.

In addition, the second end plate 11*b* having a piston hole 68 for receiving the pressure receiving head 63 of the second piston 16*b* fitted therein is attached to the second end 10*b* side of the housing 10, and the second pilot pressure chamber 17*b* is defined and formed between the second end plate 11*b* and the second piston 16*b*. The second pilot pressure chamber 17*b* is constantly in communication with the pilot supply flow channel 29 via the third flow channel port 21*c* of the housing 10 and a communication hole 69 of the second end plate 11*b*. The second end plate 11*b* is not provided with the manual operating device. A chamber between the second end 5*a* of the spool 5 and the second end plate 11*b* is a respiration chamber 70 and is opened toward the outside air.

The directional control valve 1B switches the spool 5 by a difference of operation force on the basis of the difference in surface area of the pressure receiving surfaces between the first piston 16*a* and the second piston 16*b* by turning on and off the first pilot valve 6*a* in a state in which pilot fluid is constantly supplied to the second pilot pressure chamber 17*b* and supplying and discharging the pilot fluid to/from the first pilot pressure chamber 17*a*.

Since the structure of the directional control valve 1B according to the second embodiment other than the points described above is substantially the same as the directional control valve 1A of the first embodiment, the parts of the directional control valve 1B which are the same as the directional control valve 1A are represented by the same reference numerals as the directional control valve 1A and descriptions thereof are omitted.

Figure 9:
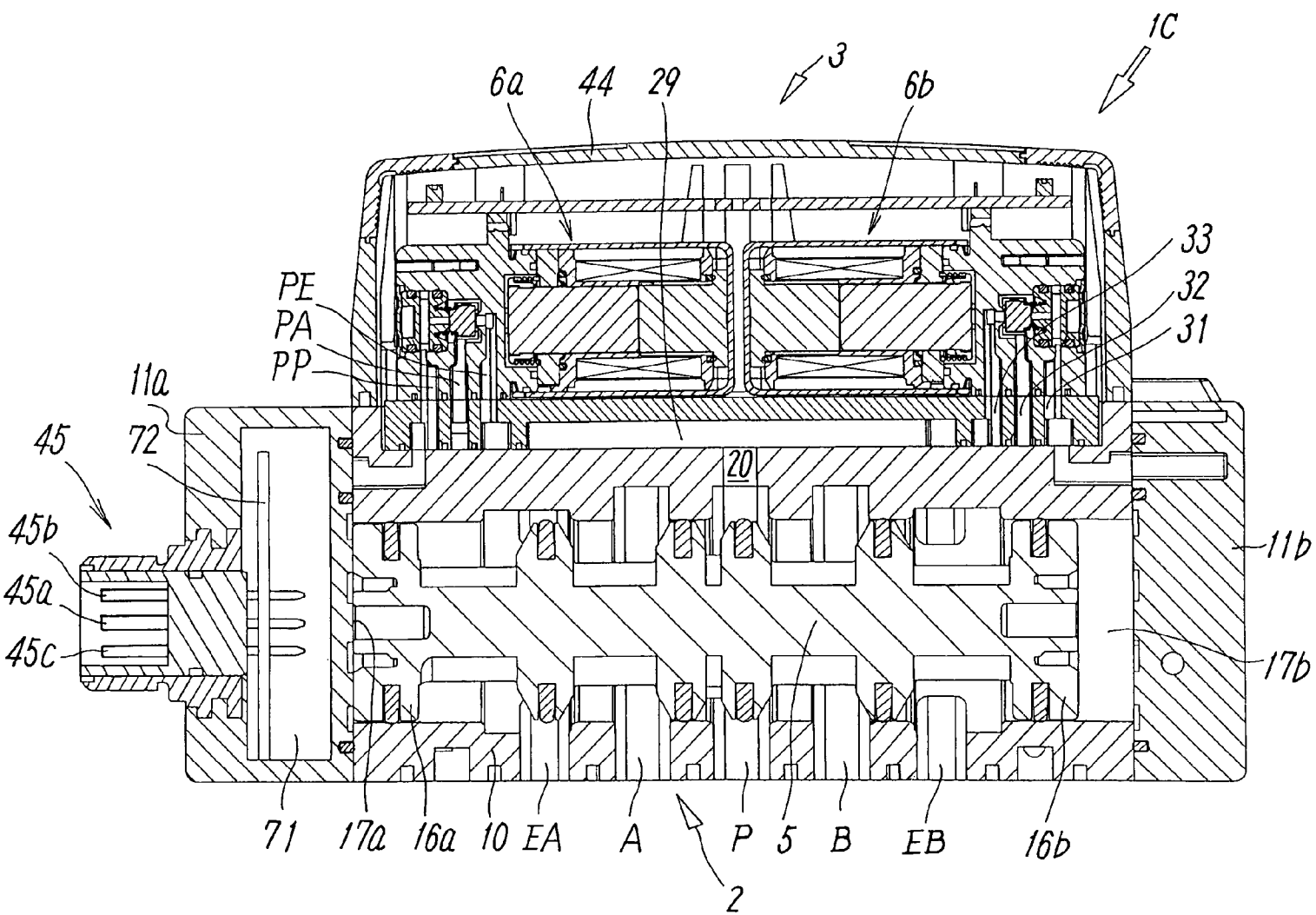
FIG. 9 is a cross sectional view showing a third embodiment of the directional control valve according to the present invention.
Figure 10:
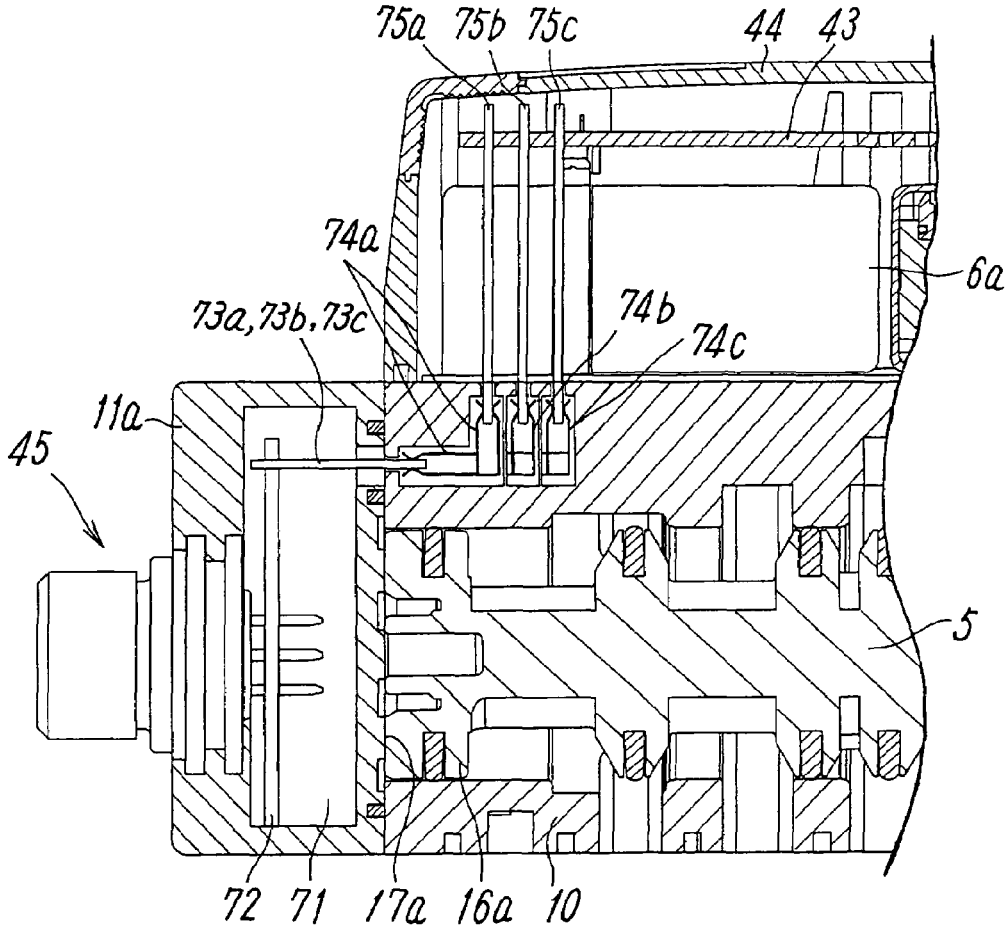
FIG. 10 is an enlarged cross-sectional view of a principal portion of the directional control valve according to the third embodiment taken along a line different from FIG. 9.

FIG. 9 and FIG. 10 show a third embodiment of the electromagnetic pilot type directional control valve according to the present invention. A different point between a directional control valve 1C of the third embodiment and the directional control valve 1A of the first embodiment is that the receiving connector 45 is formed not on the protective cover 44, but on the end plate. In other words, the receiving connector 45 is formed laterally on the first end plate 11*a*, so that the external connector from the power source can be connected from the direction of the side surface of the directional control valve.

Three terminals 45*a*, 45*b*, 45*c* of the receiving connector 45 are electrically connected to a connector board 72 provided in a board chamber 71 within the first end plate 11*a*, then, are conducted to three first board terminals 73*a*, 73*b*, 73*c* extending from the connector board 72 toward the housing 10, three relay connection terminals 74*a*, 74*b*, 74*c* provided in the housing 10, and three second board terminal 75*a*, 75*b*, 75*c* extending downward from the printed circuit board 43 in sequence, and then are electrically connected to two control circuit on the printed circuit board 43 via the second board terminals 75*a*, 75*b*, 75*c*.

The plurality of relay connection terminals 74*a*, 74*b*, 74*c* are provided at positions shifted from the mounting position of the valve adapter 4 on the housing 10 sideward and each have connecting ports facing both toward the top surface of the housing 10 and toward the end surface on the side of the first end plate 11*a*, so that the first board terminals 73*a*, 73*b*, 73*c* and the second board terminals 75*a*, 75*b*, 75*c* are connected into these connecting ports in a plug-in manner.

Although the manual operating devices are not provided on the first end plate 11*a* and the opposite second end plate 11*b* in the drawing, it is also possible to provide the manual operating devices on the end plates 11*a*, 11*b* respectively.

Since the structure of the directional control valve 1C according to the third embodiment other than the points described above is substantially the same as the directional control valve 1A of the first embodiment, the parts of the directional control valve 1C which are the same as the directional control valve 1A are represented by the same reference numerals as the directional control valve 1A and descriptions thereof are omitted.

In addition, the directional control valve 1C according to the third embodiment can be modified to a single pilot type directional control valve by replacing or adding some parts as in the case of the directional control valve 1B of the second embodiment.

The directional control valve to which the present invention can be applied is not limited to the five-port type, and may be other type, such as a three-port type. In the case of the three-port type, one each of the output port and the discharge port are provided.

The invention claimed is:

1. An electromagnetic pilot type directional control valve, comprising:

a main valve section having a housing of a rectangular shape in cross-section, the housing being provided with a supply port, an output port, and a discharge port for main fluid, a spool configured to switch a flow channel among these ports, and a piston and a pilot pressure chamber configured to drive the spool;

a valve adapter mounted on a top surface of the housing;

a pilot operating unit installed on the top surface of the housing via the valve adapter and configured to supply pilot fluid to the pilot pressure chamber by a pilot valve to drive the spool, wherein the pilot operating unit comprises:

the electromagnetic operated pilot valve mounted on the valve adapter, a printed circuit board arranged above the pilot valve and electrically connected to the pilot valve, and a protective cover mounted airtightly to the top surface of the housing and configured to cover the valve adapter, the pilot valve, and the printed circuit board entirely, wherein the valve adapter is in a plate shape elongated in a direction of an axis of the housing, and the valve adapter includes two valve mounting sections that are configured to mount the pilot valve on the top surface thereof at relative positions, and the valve adapter includes a relay hole that is configured to bring the pilot valve into communication with respective pilot flow channel ports opening on the top surface of the housing, and the top surface of the housing is formed with a recess having substantially the same shape as the valve adapter and a cover mounting surface around the recess, so that the valve adapter is fit within the recess with a first gasket mounted therebetween, a pilot supply flow channel that is led up to the supply port in cooperation with the top surface of the housing is defined, and the protective cover is mounted to the cover mounting surface via a second gasket.

2. The directional control valve according to claim 1, wherein a receiving connector for the pilot valve is provided on the top surface of the protective cover, and respective terminals of the receiving connector pass through the protective cover airtightly and extend between an inside and an outside of the cover, and distal ends thereof are electrically connected to the printed circuit board.

3. The directional control valve according to claim 1, wherein end plates are mounted to both end surfaces of the housing in the axial direction, pilot pressure chambers are defined and formed between the end plates and the respective pistons, the receiving connector for the pilot valve is provided on one of the end plates, and the respective terminals of the receiving connector are electrically connected to the printed circuit board.

4. The directional control valve according to claim 1, wherein the valve adapter is detachably attached to the housing with first screws, the pilot valve is detachably mounted to the valve adapter with second screws at a position where screwing and unscrewing of the first screws are not impaired, the printed circuit board is mounted within the protective cover, and the protective cover is detachably attached to the housing with third screws.

5. The directional control valve according to claim 4, wherein a first connector unit is provided on the top surface of the pilot valve, and a second connector unit is provided on the bottom surface of the printed circuit board, so that the connector units are electrically connected to each other in a plug-in manner when the printed circuit board is installed at a predetermined position above the pilot valve.

6. The directional control valve according to claim 4, wherein a receiving connector for the pilot valve is provided on the top surface of the protective cover, and respective terminals of the receiving connector pass through the protective cover airtightly and extend between an inside and an outside of the cover, and distal ends thereof are electrically connected to the printed circuit board.

7. The directional control valve according to claim 4, wherein end plates are mounted to both end surfaces of the housing in the axial direction, pilot pressure chambers are defined and formed between the end plates and the respective pistons, the receiving connector for the pilot valve is provided on one of the end plates, and the respective terminals of the receiving connector are electrically connected to the printed circuit board.

8. The directional control valve according to claim 1, wherein a first connector unit is provided on the top surface of the pilot valve, and a second connector unit is provided on the bottom surface of the printed circuit board, so that the connector units are electrically connected to each other in a plug-in manner when the printed circuit board is installed at a predetermined position above the pilot valve.

9. The directional control valve according to claim 8, wherein a receiving connector for the pilot valve is provided on the top surface of the protective cover, and respective terminals of the receiving connector pass through the protective cover airtightly and extend between an inside and an outside of the cover, and distal ends thereof are electrically connected to the printed circuit board.

10. The directional control valve according to claim 8, wherein end plates are mounted to both end surfaces of the housing in the axial direction, pilot pressure chambers are defined and formed between the end plates and the respective pistons, the receiving connector for the pilot valve is provided on one of the end plates, and the respective terminals of the receiving connector are electrically connected to the printed circuit board.

* * * * *